US008860546B2

(12) United States Patent
Lee et al.

(10) Patent No.: US 8,860,546 B2
(45) Date of Patent: Oct. 14, 2014

(54) MAGNETIC DEVICE

(75) Inventors: Tsung-Hsien Lee, Taoyuan Hsien (TW); Ying-Chian Kang, Taoyuan Hsien (TW); Hua-Sheng Shih, Taoyuan Hsien (TW); Chih-Tse Chen, Taoyuan Hsien (TW); Shao-Hsiung Chang, Taoyuan Hsien (TW); Chun-Liang Kuo, Taoyuan Hsien (TW); Chin-Chung Tai, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 13 days.

(21) Appl. No.: 13/610,546

(22) Filed: Sep. 11, 2012

(65) Prior Publication Data

US 2013/0229254 A1 Sep. 5, 2013

(30) Foreign Application Priority Data

Mar. 5, 2012 (TW) ..... 101107282 A

(51) Int. Cl.
*H01F 27/24* (2006.01)
*H01F 27/30* (2006.01)
*H01F 27/29* (2006.01)

(52) U.S. Cl.
USPC ..... 336/212; 336/198; 336/192

(58) Field of Classification Search
CPC ..... H01F 27/292; H01F 2005/043; H01F 2027/065; H01F 27/24; H05K 1/181; H05K 1/182; H05K 1/165; H05K 2201/086
USPC ..... 336/65, 198, 212, 221, 232
See application file for complete search history.

(56) References Cited

U.S. PATENT DOCUMENTS

| | | | | |
|---|---|---|---|---|
| 4,602,122 | A * | 7/1986 | Lint | 174/138 G |
| 6,246,311 | B1 * | 6/2001 | Finnemore et al. | 336/192 |
| 6,897,754 | B2 * | 5/2005 | Jeong et al. | 336/83 |
| 7,078,988 | B2 * | 7/2006 | Suzuki et al. | 333/181 |
| 7,116,204 | B2 * | 10/2006 | Fushimi | 336/208 |
| 7,986,208 | B2 * | 7/2011 | Yan et al. | 336/192 |
| 8,093,980 | B2 * | 1/2012 | Asou et al. | 336/192 |
| 2006/0035087 | A1 * | 2/2006 | Yadav et al. | 428/411.1 |
| 2008/0309445 | A1 | 12/2008 | Suzuki et al. | |
| 2010/0109827 | A1 | 5/2010 | Asou et al. | |
| 2011/0115596 | A1 * | 5/2011 | Lai et al. | 336/198 |
| 2011/0115598 | A1 * | 5/2011 | Wu et al. | 336/212 |

FOREIGN PATENT DOCUMENTS

JP 2010-130312 10/2010

* cited by examiner

*Primary Examiner* — Alexander Talpalatski
*Assistant Examiner* — Joselito Baisa
(74) *Attorney, Agent, or Firm* — Kirton McConkie; Evan R. Witt

(57) ABSTRACT

A magnetic device including a first magnetic core is disclosed. The first magnetic core includes a base having a first edge; a first contacting structure disposed on the base; and a second contacting structure disposed on the base, wherein a distance between an inner surface of the first contacting structure and the first edge is larger than a distance between an inner surface of the second contacting structure and the first edge.

17 Claims, 7 Drawing Sheets

MAGNETIC DEVICE

FIELD OF THE INVENTION

The present invention relates to a magnetic device, and more particularly to a slim-type magnetic device for complying with electrical safety regulations and avoiding high-voltage spark.

BACKGROUND OF THE INVENTION

Nowadays, magnetic devices such as transformers and inductors are widely used in many electrical apparatuses to generate induced magnetic fluxes. Nowadays, the electrical apparatus is developed toward to have small size and reduced volume. Consequently, the magnetic device and the conductive winding assembly of the magnetic device need to have slim appearance.

Take a conventional transformer for example. FIG. 1 is a schematic exploded view illustrating a conventional transformer. As shown in FIG. 1, the conventional transformer 1 includes a magnetic core assembly 11, a bobbin 12, a primary winding coil 13, and a secondary winding coil 14. The primary winding coil 13 and the secondary winding coil 14 are overlapped with each other and wound around a winding section 121 of the bobbin 12. An isolating tape 2 is provided for isolation and insulation. The bobbin 12 further includes a channel 122. Several pins 123 are disposed on the bottom surfaces of the both sides of the bobbin 12. The pins 123 are connected with the primary winding coil 13 and the secondary winding coil 14. Via pins 123, the primary winding coil 13 and the secondary winding coil 14 are electrically connected with a circuit board (not shown). As shown in FIG. 1, the magnetic core assembly 11 is an EE-type magnetic core assembly. The magnetic core assembly 11 includes a first magnetic core 111 and a second magnetic core 112. The first magnetic core 111 has a first middle portion 111*a*, and the second magnetic core 112 has a second middle portion 112*a*.

For assembling the transformer 1, the first middle portion 111*a* of the first magnetic core 111 and the second middle portion 112*a* of the second magnetic core 112 are firstly aligned with and embedded into the channel 122 of the bobbin 12, and then the first magnetic core 111 and the second magnetic core 112 are combined together. Consequently, the primary winding coil 13 and the secondary winding coil 14 interact with the first magnetic core 111 and a second magnetic core 112 of the magnetic core assembly 11 to achieve the purpose of voltage regulation.

Generally, the bobbin 12 of the transformer 1 is made of a plastic material. Since the bobbin 12 includes the winding section 121, the channel 122 and other structures, the volume and thickness of the bobbin 12 are very large. Moreover, after the primary winding coil 13 and the secondary winding coil 14 are wound around the winding section 121 of the bobbin 12 and the magnetic core assembly 11 is assembled with the bobbin 12, the volume of the bobbin 12 is increased. In other words, it is difficult to slim the conventional transformer 1.

Moreover, after the primary winding coil 13 and the secondary winding coil 14 are overlapped with each other and wound around the winding section 121 of the bobbin 12, the primary winding coil 13 and the secondary winding coil 14 are connected to the pins 121. If the safety distance is insufficient, the exposed parts of the primary winding coil 13 and the secondary winding coil 14 are readily suffered from high-voltage spark. Consequently, the transformer 1 is easily damaged.

Therefore, there is a need of providing an improved magnetic device so as to obviate the drawbacks encountered in the prior art.

SUMMARY OF THE INVENTION

The present invention provides a slim-type magnetic device for avoiding the occurrence of the high-voltage spark and minimizing the possibility of damaging the magnetic device.

In accordance with an aspect of the present invention, there is provided a magnetic device including a first magnetic core. The first magnetic core includes a base having a first edge; a first contacting structure disposed on the base; and a second contacting structure disposed on the base, wherein a distance between an inner surface of the first contacting structure and the first edge is larger than a distance between an inner surface of the second contacting structure and the first edge.

In accordance with another aspect of the present invention, there is provided a magnetic device including a first magnetic core. The first magnetic core includes a base having a first edge; a first contacting structure disposed on the base; and a second contacting structure disposed on the base, wherein an outer surface of one of the first contacting structure and the second contacting structure is coplanar with the first edge, and an outer surface of the other one of the first contacting structure and the second contacting structure is separated from the first edge by a distance.

In accordance with a further aspect of the present invention, there is provided a magnetic device. The magnetic device includes a first magnetic core, a first winding coil assembly wound around the first magnetic core; and a second winding coil assembly wound around the first magnetic core, wherein a winding length of the first winding coil assembly is not equal to a winding length of the second winding coil assembly.

In accordance with a further aspect of the present invention, there is provided a magnetic device. The magnetic device includes a first magnetic core; and a second magnetic core combined with the first magnetic core, wherein the first magnetic core and the second magnetic core are combined together through a magnetic adhesive, the magnetic adhesive is composed of magnetic powder particles, and a diameter of the magnetic powder particle is smaller than 1000 nm.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
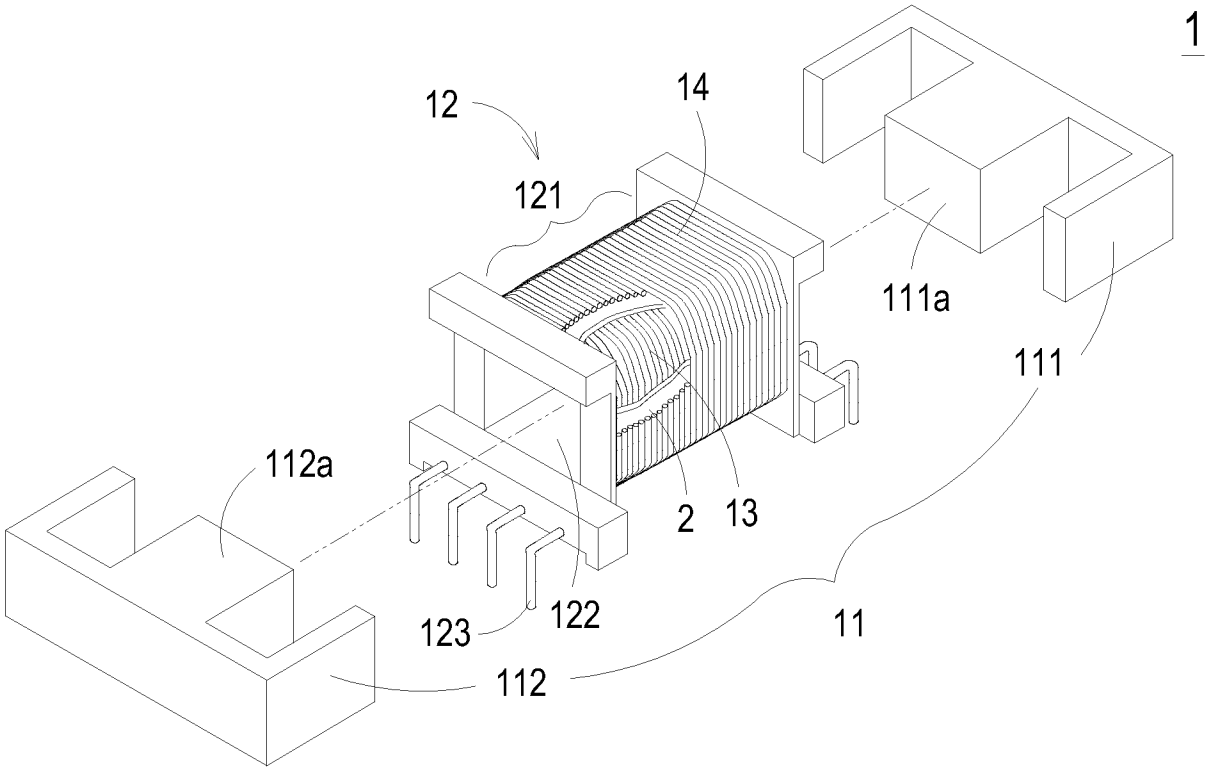
FIG. 1 (PRIOR ART)
FIG. 1 is a schematic exploded view illustrating a conventional transformer.
Figure 2:
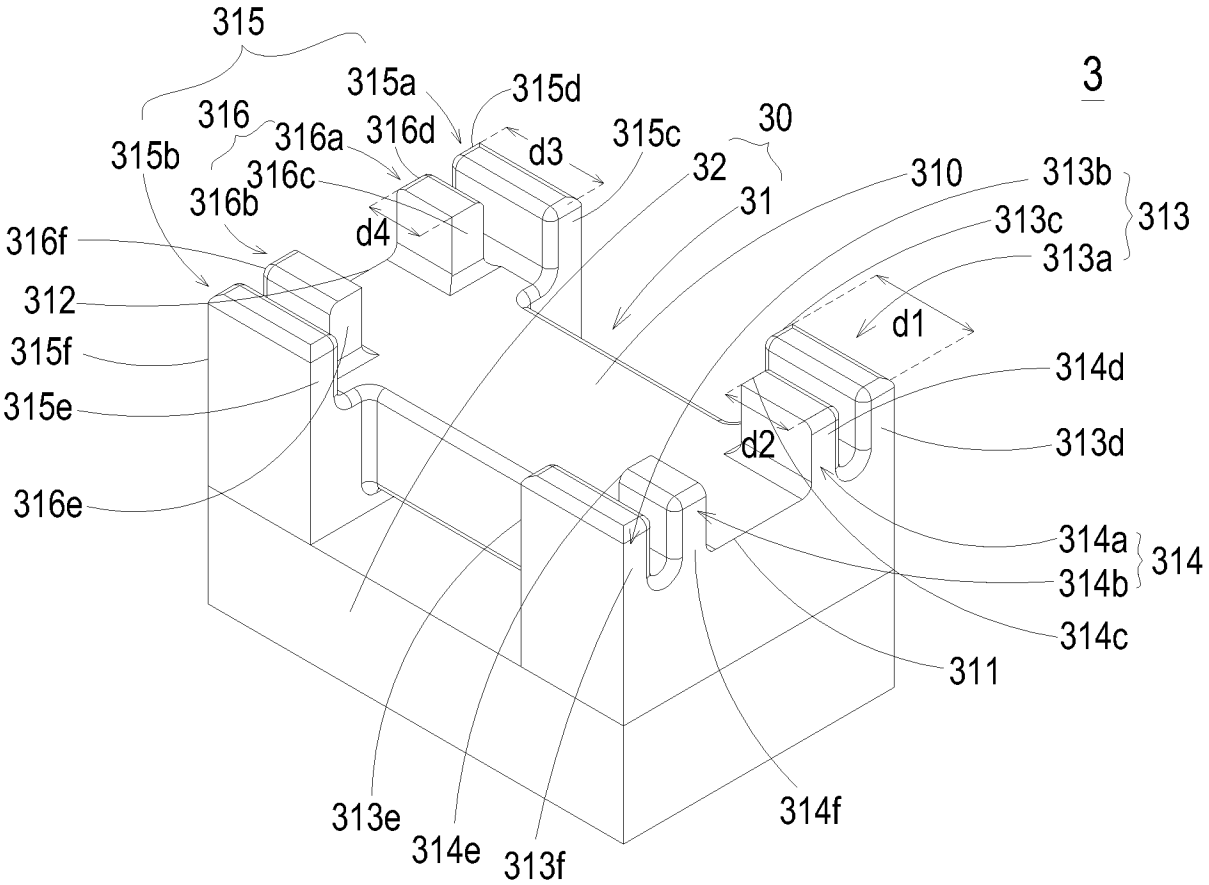
FIG. 2 is a schematic perspective view illustrating a magnetic core assembly of a magnetic device according to a first embodiment of the present invention.

FIG. 2 is a schematic perspective view illustrating a magnetic core assembly of a magnetic device according to a first embodiment of the present invention. The magnetic device 3 includes a magnetic core assembly 30. The magnetic core assembly 30 includes a first magnetic core 31 and a second magnetic core 32. In this embodiment, the first magnetic core 31 is a drum core, and the second magnetic core 32 is a plate core. It is noted that numerous modifications and alterations of the magnetic core assembly 30 may be made while retaining the teachings of the invention.

The first magnetic core 31 has a base 310. The base 310 has a first edge 311 and a second edge 312. The first edge 311 and the second edge 312 are opposite to each other. Furthermore, a first contacting structure 313 and a second contacting structure 314 are formed on the base 310 of the first magnetic core 31. The first contacting structure 313 and the second contacting structure 314 are located beside the first edge 311. With respect to the center of the base 310, the first contacting structure 313 is located at the outer side, and the second contacting structure 314 is located at the inner side. In accordance with the present invention, the first contacting structure 313 includes two or more contacting units, and the second contacting structure 314 includes one or more contacting units. In this embodiment, the first contacting structure 313 includes two contacting units 313*a*, 313*b*, and the second contacting structure 314 includes two contacting units 314*a*, 314*b*. Preferably, the two contacting units 314*a*, 314*b* of the second contacting structure 314 are disposed between the two contacting units 313*a*, 313*b* of the first contacting structure 313. In some other embodiments, the second contacting structure 314 may include a single contacting unit. The number of the contacting units of the first contacting structure 313 and the second contacting structure 314 may be varied according to the practical requirements.

Please refer to FIG. 2 again. With respect to the center of the base 310, the contacting unit 313*a* of the first contacting structure 313 has an inner surface 313*c* and an outer surface 313*d*, and the contacting unit 313*b* of the first contacting structure 313 has an inner surface 313*e* and an outer surface 313*f*. Similarly, with respect to the center of the base 310, the contacting unit 314*a* of the second contacting structure 314 has an inner surface 314*c* and an outer surface 314*d*, and the contacting unit 314*b* of the second contacting structure 314 has an inner surface 314*e* and an outer surface 314*f*. The distance d1 between the inner surface 313*c* (or 313*e*) of the first contacting structure 313 and the first edge 311 is larger than the distance d2 between the inner surface 314*c* (or 314*e*) of the second contacting structure 314 and the first edge 311. In a preferred embodiment, the outer surfaces 313*d*, 313*f* of the contacting unit 313*a* and the outer surfaces 314*d*, 314*f* of the second contacting structure 314 are coplanar with the first edge 311. In some other embodiments, the inner surfaces 313*c*, 313*e* of the first contacting structure 313 and the inner surfaces 314*c*, 314*e* of the second contacting structure 314 are not parallel with the first edge 311 and are not coplanar with each other. Under this circumstance, the stability and strength of fixing the terminals of the coils will be enhanced, and the possibility of resulting in the high-voltage spark will be minimized. In this embodiment, the length of the first contacting structure 313 is not equal to the length of the second contacting structure 314.

Please refer to FIG. 2 again. In this embodiment, another first contacting structure 315 and another second contacting structure 316 are formed on the base 310 of the first magnetic core 31. The first contacting structure 315 and the second contacting structure 316 are located beside the second edge 312. In accordance with the present invention, the first contacting structure 315 includes two or more contacting units, and the second contacting structure 316 includes one or more contacting units. In this embodiment, the first contacting structure 315 includes two contacting units 315*a*, 315*b*, and the second contacting structure 316 includes two contacting units 316*a*, 316*b*. Preferably, the two contacting units 315*a*, 315*b* of the first contacting structure 315 are disposed between the two contacting units 316*a*, 316*b* of the second contacting structure 316. The distance d3 between the inner surface 315*c* (or 315*e*) of the first contacting structure 315 and the second edge 312 is larger than the distance d4 between the inner surface 316*c* (or 316*e*) of the second contacting structure 316 and the second edge 312. In a preferred embodiment, the outer surfaces 315*d*, 315*f* of the contacting unit 315*a* and the outer surfaces 316*d*, 316*f* of the second contacting structure 316 are coplanar with the second edge 312.

As shown in FIG. 2, the first contacting structure 313 and the second contacting structure 314 beside the first edge 311 and the first contacting structure 315 and the second contacting structure 316 beside the second edge 312 are symmetrically arranged on the base 310 of the first magnetic core 31.

Figure 3:
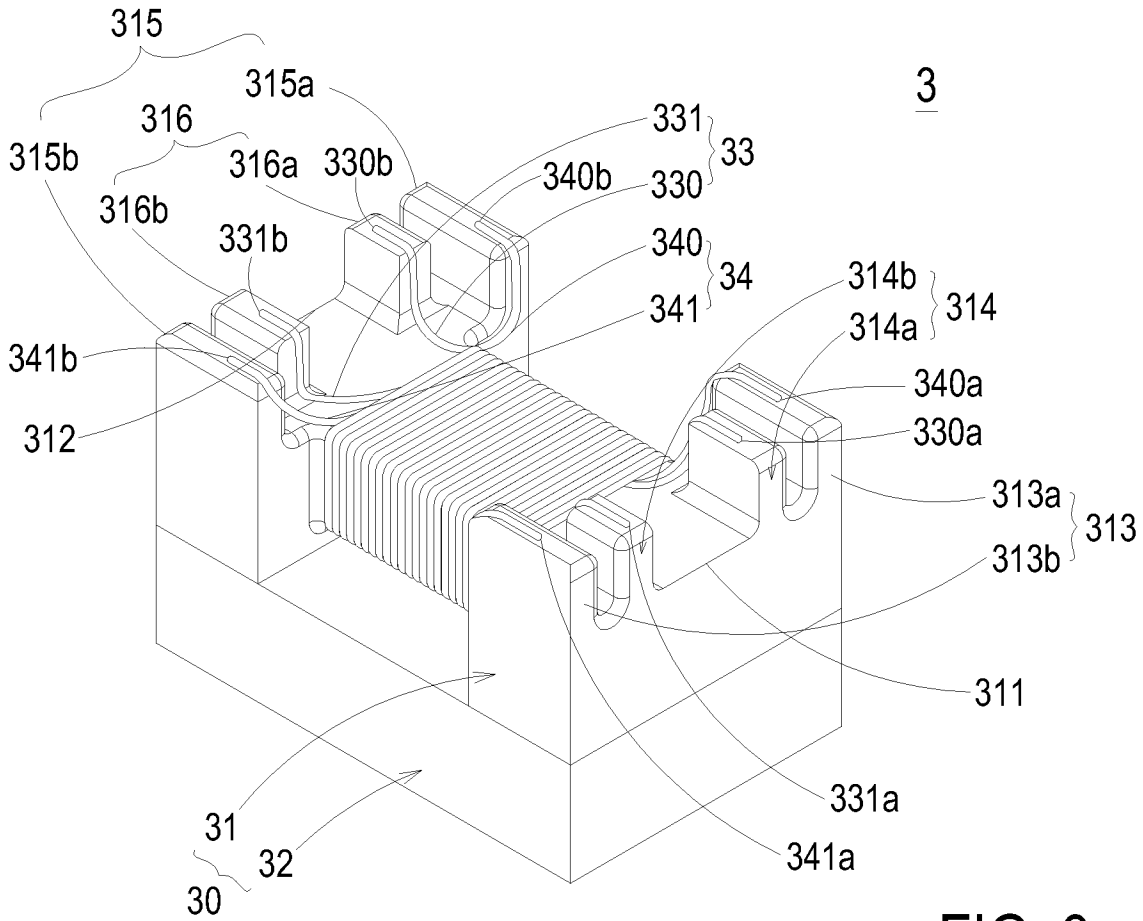
FIG. 3 is a schematic perspective illustrating a magnetic device with the magnetic core assembly of FIG. 2.

FIG. 3 is a schematic perspective illustrating a magnetic device with the magnetic core assembly of FIG. 2. In addition to the magnetic core assembly 30, the magnetic device 3 further includes a first winding coil assembly 33 and a second winding coil assembly 34. The first winding coil assembly 33 and the second winding coil assembly 34 are wound around the first magnetic core 31 of the magnetic core assembly 30. The first winding coil assembly 33 is electrically connected with the second contacting structures 314 and 316. The second winding coil assembly 34 is electrically connected with the first contacting structures 313 and 315. Consequently, the first winding coil assembly 33 and the second winding coil assembly 34 interact with the first magnetic core 31 and the second magnetic core 32 of the magnetic core assembly 30 to achieve the purpose of voltage regulation.

An example of the magnetic device 3 includes but is not limited to a transformer. The first winding coil assembly 33 may include one or more conducting wires, and the second winding coil assembly 34 may include one or more conducting wires. In this embodiment, the first winding coil assembly 33 has two first conducting wires 330 and 331, and the second winding coil assembly 34 has two second conducting wires 340 and 341. The winding directions of the two first conducting wires 330 and 331 may be different. The winding directions of the two second conducting wires 340 and 341 may be different. Optionally, the winding directions of the first winding coil assembly 33 and the second winding coil assembly 34 are different. In such way, the electromagnetic coupling effect of the magnetic device 3 may be enhanced. The first conducting wire 330 of the first winding coil assembly 33 has two terminals 330*a* and 330*b*. The first conducting wire 331 of the first winding coil assembly 33 has two terminals 331*a* and 331*b*. The terminal 330*a* of the first conducting wire 330 is electrically connected with the contacting unit 314*a* of the second contacting structure 314. The terminal 331*a* of the first conducting wire 330 is electrically connected with contacting unit 314*b* of the second contacting structure 314. The terminal 330*b* of the first conducting wire 330 is electrically connected with the contacting unit 316*a* of the second contacting structure 316. The terminal 331*b* of the first conducting wire 331 is electrically connected with contacting unit 316*b* of the second contacting structure 316. The second conducting wire 340 of the second winding coil assembly 34 has two terminals 340*a* and 340*b*. The second conducting wire 341 of the second winding coil assembly 34 has two terminals 341*a* and 341*b*. The terminal 340*a* of the second conducting wire 340 is electrically connected with the contacting unit 313*a* of the first contacting structure 313. The terminal 341*a* of the second conducting wire 340 is electrically connected with the contacting unit 313*b* of the first contacting structure 313. The terminal 340*b* of the second conducting wire 340 is electrically connected with the contacting unit 315*a* of the first contacting structure 315. The terminal 341*b* of the second conducting wire 340 is electrically connected with the contacting unit 315*b* of the first contacting structure 315.

Figure 4:
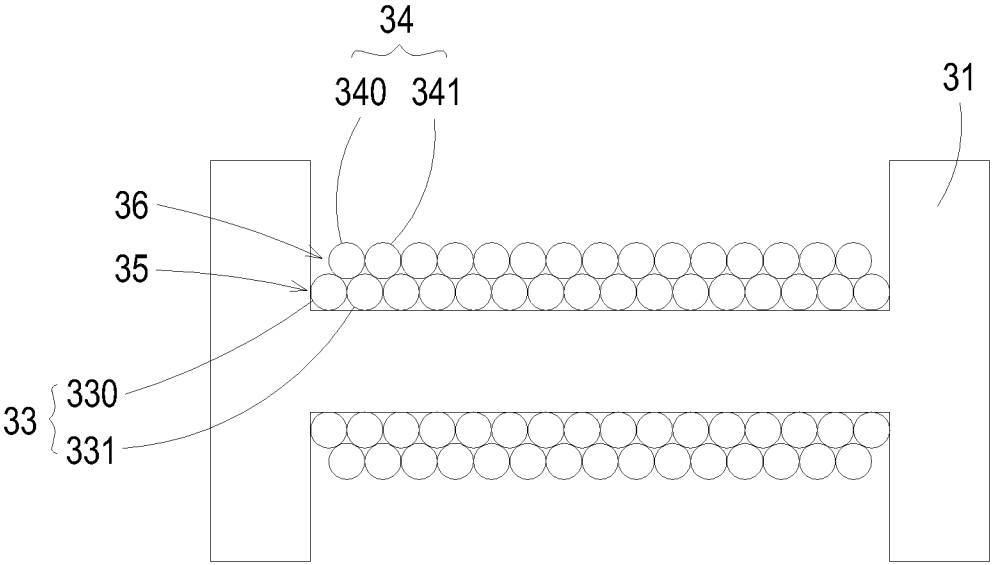
FIG. 4 is a schematic cross-sectional view illustrating the relationship between the first magnetic core, the first winding coil assembly and the second winding coil assembly of the magnetic device of FIG. 3.

FIG. 4 is a schematic cross-sectional view illustrating the relationship between the first magnetic core, the first winding coil assembly and the second winding coil assembly of the magnetic device of FIG. 3. Please refer to FIGS. 3 and 4. After the terminals 330*a* and 331*a* of the first conducting wires 330 and 331 of the first winding coil assembly 33 are electrically connected with and fixed on the contacting units 314*a* and 314*b* of the second contacting structure 314, the first winding coil assembly 33 is wound around the middle segment of the first magnetic core 31, so that a first winding layer 35 is defined (see FIG. 4). Next, the terminals 330*b* and 331*b* of the first conducting wires 330 and 331 of the first winding coil assembly 33 are electrically connected with and fixed on the contacting units 316*a* and 316*b* of the second contacting structure 316.

Next, the terminals 340*a* and 341*a* of the second conducting wires 340 and 341 of the second winding coil assembly 34 are electrically connected with and fixed on the contacting units 313*a* and 313*b* of the first contacting structure 313. Next, the second winding coil assembly 34 is wound around the middle segment of the first magnetic core 31, so that a second winding layer 36 is defined (see FIG. 4). Next, the terminals 340*b* and 341*b* of the second conducting wires 340 and 341 of the second winding coil assembly 34 are electrically connected with the contacting units 315*a* and 315*b* of the first contacting structure 315. It is noted that the winding ways of the first winding coil assembly 33 and the second winding coil assembly 34 may be altered according to the practical requirements. For example, the sequence of winding the first winding coil assembly 33 and the second winding coil assembly 34 may be changed.

From the above discussions, the method of winding the first winding coil assembly 33 and the second winding coil assembly 34 of the magnetic device 3 may be automatically performed. In comparison with the manual winding method, the process of fabricating the magnetic device 3 of the present invention is time-saving and the winding quality is enhanced.

Hereinafter, the relationships between the winding coil assemblies 33, 34 and the contacting structures 313, 314 will be illustrated with reference to FIGS. 2, 3 and 4. The relationships between the winding coil assemblies 33, 34 and the contacting structures 315, 316 are similar to the relationships between the winding coil assemblies 33, 34 and the contacting structures 313, 314, and are not redundantly described herein. The first winding coil assembly 33 and the second winding coil assembly 34 are wound around the first magnetic core 31. That is, the first winding coil assembly 33 is firstly wound around the first magnetic core 31 to define the first winding layer 35, and then the second winding coil assembly 34 is wound around the first magnetic core 31 to define the second winding layer 36. As previously described, the distance d1 between the inner surface 313*c* (or 313*e*) of the first contacting structure 313 and the first edge 311 is larger than the distance d2 between the inner surface 314*c* (or 314*e*) of the second contacting structure 314 and the first edge 311. Consequently, the connecting regions between the terminals 340*a*, 341*a* of the second winding coil assembly 34 and the first contacting structure 313 and the connecting regions between the terminals 330*a*, 331*a* of the first winding coil assembly 33 and the second contacting structure 314 are arranged in a staggered form. In other words, since there is a sufficient safety distance between the first winding coil assembly 33 and the second winding coil assembly 34, the possibility of resulting in the high-voltage spark will be minimized.

Moreover, since the second contacting structure 314 is shorter than the first contacting structure 313 (i.e. the distance d2 between the inner surface 314*c* (or 314*e*) of the second contacting structure 314 and the first edge 311 is shorter than the distance d1 between the inner surface 313*c* (or 313*e*) of the first contacting structure 313 and the first edge 311), after the both terminals of the winding coil assemblies 33, 34 are fixed on the contacting structures 314, 316, 313, 315, the winding length of the first conducting wire 330 (or 331) of the first winding coil assembly 33 is not equal to the winding length of the second conducting wire 340 (or 341) of the second winding coil assembly 34. In this embodiment, the winding length of the first winding coil assembly 33 is larger than the winding length of the second winding coil assembly 34.

Figure 5:
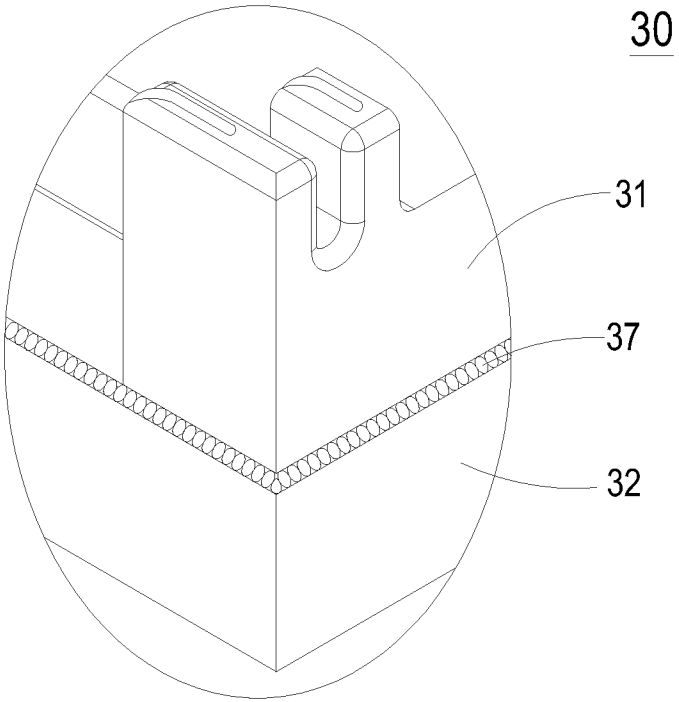
FIG. 5 is a schematic partial perspective view illustrating the relationship between the first magnetic core, the first winding coil assembly and the second winding coil assembly of the magnetic device of FIG. 3.

FIG. 5 is a schematic partial perspective view illustrating the relationship between the first magnetic core, the first winding coil assembly and the second winding coil assembly of the magnetic device of FIG. 3. After the first winding coil assembly 33 and the second winding coil assembly 34 are wound around the first magnetic core 31, the combination of the first winding coil assembly 33, the second winding coil assembly 34 and the first magnetic core 31 is attached on the second magnetic core 32 via a magnetic adhesive 37. Since the gap between the first magnetic core 31 and the second magnetic core 32 is filled with the magnetic adhesive 37, the first magnetic core 31 and the second magnetic core 32 are securely coupled with each other without any other bonding medium. In addition, since the magnetic adhesive 37 is magnetically conductive, the inductance of the magnetic device 3 may be enhanced. For example, the magnetic adhesive 37 is a colloid containing a magnetically-conductive material. An example of the magnetically-conductive material includes but is not limited to iron, cobalt or nickel. An example of the colloid includes but is not limited to silicon or epoxy resin. Moreover, the magnetic adhesive 37 may be composed of fine magnetic powder particles. The diameter of the magnetic powder particle is smaller than 5000 nm, preferably smaller than 1000 nm, more preferably in the range between 10 nm and 100 nm. As the diameter of the magnetic powder particle is reduced, the gap-filling efficacy and the magnetically-conductive efficacy will be increased. Especially, when the diameter of the magnetic powder particle is in the range between 10 nm and 100 nm, the gap-filling efficacy and the magnetically-conductive efficacy are obvious.

Figure 6:
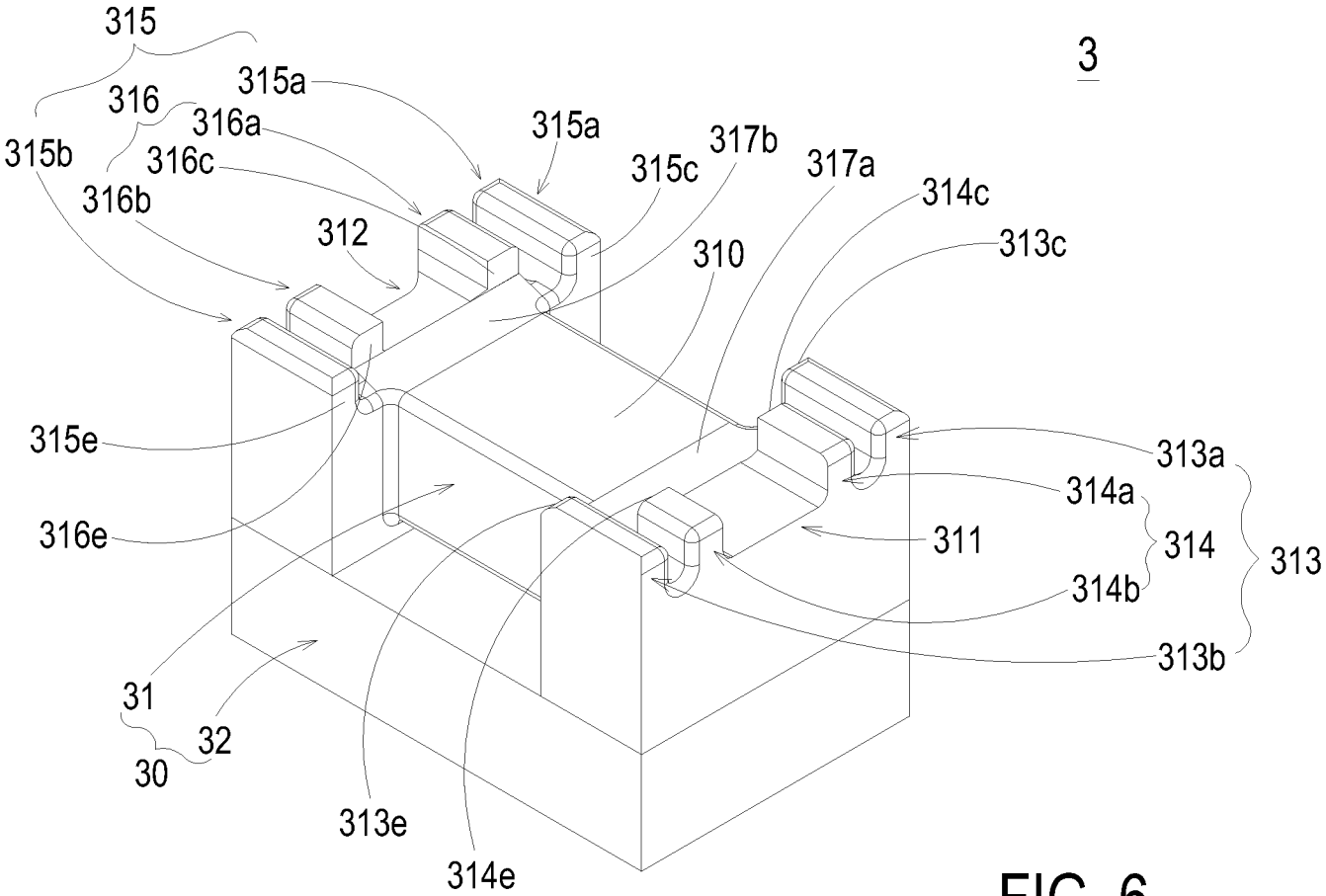
FIG. 6 is a schematic perspective view illustrating a magnetic core assembly of a magnetic device according to a second embodiment of the present invention.

FIG. 6 is a schematic perspective view illustrating a magnetic core assembly of a magnetic device according to a second embodiment of the present invention. Except for the following items, the configurations of the first magnetic core 31 and the second magnetic core 32 of the magnetic device 3 are similar to those of the first embodiment, and are not redundantly described herein. In this embodiment, the first magnetic core 31 further includes two inclined structures 317*a* and 317*b*. The inclined structure 317*a* is in contact with the contacting unit 313*a*, 313*b* of the first contacting structure 313 and/or the contacting units 314*a*, 314*b* of the second contacting structure 314. Moreover, the inclined structure 317*a* is inclined downwardly from the inner surfaces 314*c*, 314*e* of the contacting units 314*a*, 314*b* of the second contacting structure 314 to the base 310 beside the inner surfaces 313*c*, 313*e* of the contacting unit 313*a*, 313*b* of the first contacting structure 313. Similarly, the inclined structure 317*b* is in contact with the contacting unit 315*a*, 315*b* of the first contacting structure 315 and/or the contacting units 316*a*, 316*b* of the second contacting structure 316. The inclined structure 317*b* is inclined downwardly from the inner surfaces 316*c*, 316*e* of the contacting units 316*a*, 316*b* of the second contacting structure 316 to the base 310. Due to the inclined structures 317*a* and 317*b*, the structural strength of the first magnetic core 31 and the contacting structures 313, 315, 314, 316 will be enhanced. In addition, the possibility of resulting in the high-voltage spark will be minimized.

Figure 7:
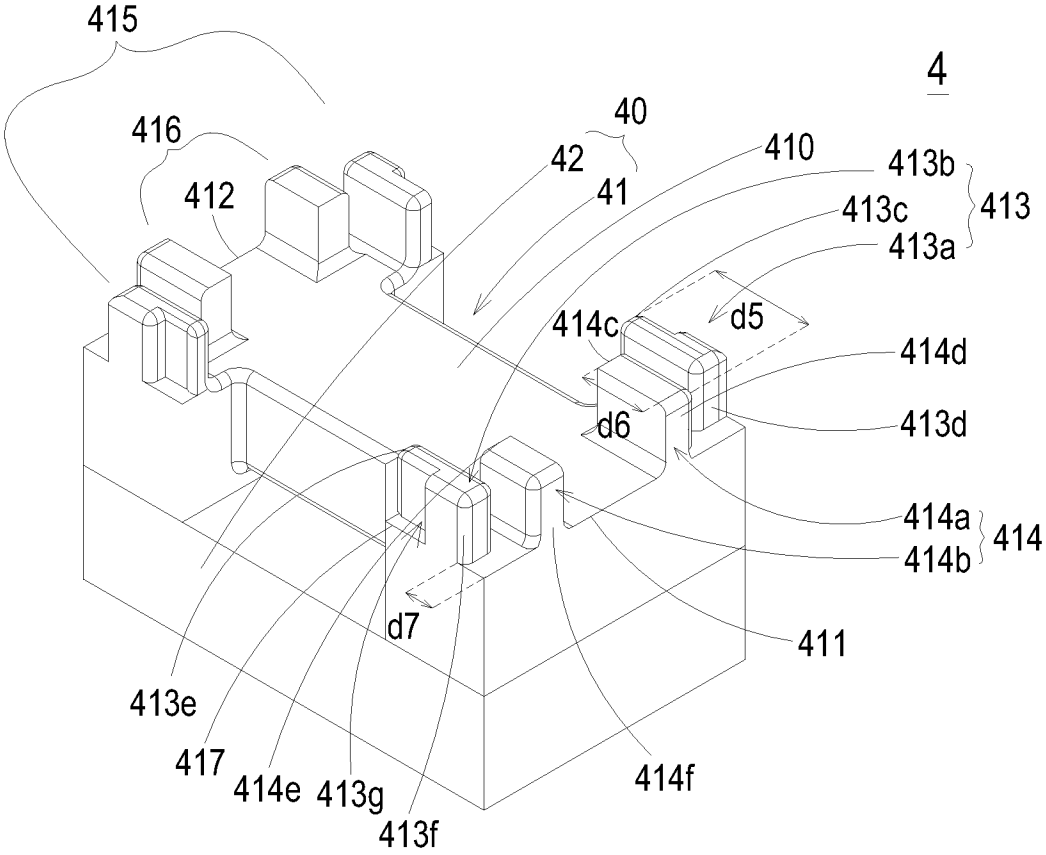
FIG. 7 is a schematic perspective view illustrating a magnetic core assembly of a magnetic device according to a third embodiment of the present invention.

FIG. 7 is a schematic perspective view illustrating a magnetic core assembly of a magnetic device according to a third embodiment of the present invention. The magnetic device 4 includes a magnetic core assembly 40. The magnetic core assembly 40 includes a first magnetic core 41 and a second magnetic core 42. The first magnetic core 41 has a base 410. The base 410 has a first edge 411 and a second edge 412. The first edge 411 and the second edge 412 are opposite to each other. Furthermore, a first contacting structure 413 and a second contacting structure 414 are formed on the base 410 of the first magnetic core 41, and located beside the first edge 411. Similarly, another first contacting structure 415 and another second contacting structure 416 are formed on the base 410 of the first magnetic core 41, and located beside the second edge 412. The configuration and arrangement of the contacting structures 415, 416 are similar to those of the contacting structures 413, 414, and are not redundantly described herein.

In this embodiment, the first contacting structure 413 includes two contacting units 413*a*, 413*b*, and the second contacting structure 414 includes two contacting units 414*a*, 414*b*. The number of the contacting units of the first contacting structure 413 and the second contacting structure 414 may be varied according to the practical requirements. The contacting unit 413*a* of the first contacting structure 413 has an inner surface 413*c* and an outer surface 413*d*. Similarly, the contacting unit 413*b* of the first contacting structure 413 has an inner surface 413*e* and an outer surface 413*f*. The contacting unit 414*a* of the second contacting structure 414 has an inner surface 414*c* and an outer surface 414*d*. Similarly, the contacting unit 414*b* of the second contacting structure 414 has an inner surface 414*e* and an outer surface 414*f*. The distance d5 between the inner surface 413*c* (or 413*e*) of the first contacting structure 413 and the first edge 411 is larger than the distance d6 between the inner surface 414*c* (or 414*e*) of the second contacting structure 414 and the first edge 411.

In this embodiment, the outer surface 413*d* (or 413*f*) of the first contacting structure 413 is separated from the first edge 411 by a distance d7. The outer surfaces 414*d* and 414*f* of the second contacting structure 414 are coplanar with the first edge 411. That is, the outer surface 413*d* (or 413*f*) of the first contacting structure 413 and the outer surface 414*d* (or 414*f*) of the second contacting structure 414 are not coplanar. Since the outer surface 413*d* (or 413*f*) of the first contacting structure 413 is separated from the first edge 411 by the distance d7, the winding space of first magnetic core 41 is increased for facilitating the winding task. Moreover, since the distance between the first contacting structure 413 and the second contacting structure 414 is increased, the high-voltage spark can be further reduced.

Moreover, the first contacting structure 413 and/or the second contacting structure 414 further include a concave structure 413*g*. In an embodiment, the concave structure 413*g* is formed in the inner surface 413*e* (or 413*c*) of the first contacting structure 413 and formed in a third edge 417 of the first magnetic core 41. The third edge 417 of the first magnetic core 41 is located beside the first edge 411. The concave structure 413*g* may assist in fixing the terminals of the conducting wires. Consequently, the welding task is simplified and the welding strength is increased.

From the above description, the present invention provides a magnetic device. The magnetic device includes a first magnetic core, a second magnetic core, a first winding coil assembly, and a second winding coil assembly. The first magnetic core has a base. A first contacting structure and a second contacting structure are formed on the base of the first magnetic core, and located beside at least one edge of the base. The distance between the inner surface of the first contacting structure and the edge is larger than the distance between the inner surface of the second contacting structure and the first edge. After the first winding coil assembly and the second winding coil assembly are respectively connected with the second contacting structure and the first contacting structure and wound around the first magnetic core, the winding length of the first winding coil assembly is not equal to the winding length of the second winding coil assembly. Consequently, there is a safety distance between the first winding coil assembly and the second winding coil assembly to avoid the occurrence of the high-voltage spark and minimize the possibility of damaging the magnetic device. In some embodiments, at least one inclined structure is further formed on the base of the first magnetic core in order to enhance the structural strength of the first magnetic core. Alternatively, the outer surface of the first contacting structure or the second contacting structure is separated from the edge by a distance. Alternatively, the first contacting structure or the second contacting structure further has a concave structure for simplifying the welding task and increasing the welding strength. Moreover, since the first magnetic core and the second magnetic core may be securely combined together via the magnetically-conductive magnetic adhesive, the inductance of the magnetic device will be enhanced. Moreover, since the first winding coil assembly and the second winding coil assembly are directly wound around the first magnetic core, the overall volume of the magnetic device of the present invention is effectively reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A magnetic device, comprising:

a first magnetic core comprising:

a base having a first side, a second side opposite the first side, a third side that extends between the first and second sides, and a fourth side opposite the third side;

a first contacting structure that protrudes from the base, the first contacting structure being positioned along the first and third sides such that outer surfaces of the first contacting structure form part of the first and third sides, the first contacting structure having a first inner surface that is opposite the first side and a second inner surface that is opposite the third side; and a second contacting structure that protrudes from the base, the second contacting structure being positioned along the first side such that an outer surface of the second contacting structure forms part of the first side, the second contacting structure being spaced from the first contacting structure such that a first inner surface of the second contacting structure faces the second inner surface of the first contacting structure, the second contacting structure also having a second inner surface that is opposite the first side and a third inner surface that is opposite the first inner surface of the second contacting structure;

wherein a distance between the first inner surface of the first contacting structure and the first side is larger than a distance between the second inner surface of the second contacting structure and the first side.

2. The magnetic device according to claim 1, wherein the base of the first magnetic core further has an inclined structure, wherein the inclined structure contacts the first contacting structure and/or the second contacting structure.

3. The magnetic device according to claim 1, wherein the first inner surface of the first contacting structure and the second inner surface of the second contacting structure are not parallel with the first side or coplanar with each other.

4. The magnetic device according to claim 1, wherein the third inner surface of the second contacting structure is spaced from the fourth side.

5. The magnetic device according to claim 1, wherein one or both of the first contacting structure and the second contacting structure has a concave structure.

6. The magnetic device according to claim 1, further comprising:

a first winding coil assembly and a second winding coil assembly, which are wound around the first magnetic core; and a second magnetic core combined with the first magnetic core.

7. The magnetic device according to claim 6, wherein the first magnetic core is a drum core, and the second magnetic core is a plate core.

8. The magnetic device according to claim 6, wherein the first magnetic core and the second magnetic core are combined together through a magnetic adhesive composed of magnetic powder particles, wherein a diameter of the magnetic powder particles is smaller than 1000 nm.

9. The magnetic device according to claim 6, wherein a winding length of the first winding coil assembly is not equal to a winding length of the second winding coil assembly.

10. The magnetic device according to claim 6, wherein a winding direction of the first winding coil assembly is different from a winding direction of the second winding coil assembly.

11. A magnetic device, comprising:

a first magnetic core comprising:

a base having a first side, a second side opposite the first side, a third side that extends between the first and second sides, and a fourth side opposite the third side;

four corner contacting structures that each protrude from a respective corner of the base such that each corner contacting structure has two outer surfaces that form part of two sides of the base, each corner contacting structure also having an inner surface that opposes the first or second side of the base respectively;

four inner contacting structures that each protrude from the base, wherein a first two of the inner contracting structures have an outer surface that forms part of the first side and an inner surface that is opposite the first side and a second two of the inner contacting structures have an outer surface that forms part of the second side and an inner surface that is opposite the second side such that the first two of the inner contacting structures are positioned between a first two of the corner contacting structures and a second two of the inner contacting structures are positioned between a second two of the corner contacting structures;

wherein a distance between the first side and the inner surface of at least one of the first two corner contacting structures is greater than the distance between the first side and the inner surface of the adjacent inner contacting structure, and a distance between the second side and the inner surface of at least one of the second two corner contacting structures is greater than the distance between the second side and the inner surface of the adjacent inner contacting structure.

12. The magnetic device according to claim 11, wherein the base has an inclined structure from which the corner and inner contacting structures protrude.

13. The magnetic device according to claim 11, wherein the inner surfaces of a corner contacting structure and an adjacent inner contacting structure are not parallel with the respective first or second side or coplanar with each other.

14. The magnetic device according to claim 11, further comprising:

a first winding coil assembly and a second winding coil assembly, which are wound around the first magnetic core; and a second magnetic core combined with the first magnetic core.

15. The magnetic device according to claim 14, wherein a winding direction of the first winding coil assembly is different from a winding direction of the second winding coil assembly.

16. The magnetic device according to claim 14, wherein a winding length of the first winding coil assembly is not equal to a winding length of the second winding coil assembly.

17. The magnetic device according to claim 11, further comprising a second magnetic core combined with the first magnetic core via a magnetic adhesive composed of magnetic powder particles having a diameter smaller than 1000 nm.

* * * * *